United States Patent [19]

Roussin et al.

[11] 4,379,595

[45] Apr. 12, 1983

[54] RIPPER WITH OFFSET IMPACTING MEANS AND SLOTTED SHANK

[75] Inventors: Michael A. Roussin; Steven D. Jones; Albert L. Woody, all of Peoria, Ill.

[73] Assignee: Caterpillar Tractor Co., Peoria, Ill.

[21] Appl. No.: 277,741

[22] PCT Filed: Feb. 17, 1981

[86] PCT No.: PCT/US81/00209

§ 371 Date: Feb. 17, 1981

§ 102(e) Date: Feb. 17, 1981

[87] PCT Pub. No.: WO82/02813

PCT Pub. Date: Sep. 2, 1982

[51] Int. Cl.[3] ..... E01C 23/09; A01B 35/00

[52] U.S. Cl. ..... 299/37; 299/14; 172/40; 37/DIG. 18

[58] Field of Search ..... 299/14, 37, 62, 67, 299/70; 37/DIG. 18; 173/128, 131, 132; 172/40

[56] References Cited

U.S. PATENT DOCUMENTS

| | | | |
|---|---|---|---|
| 1,581,705 | 4/1926 | Waxbom | 299/37 |
| 3,437,381 | 4/1969 | Bodine | 299/37 |
| 3,527,501 | 9/1970 | Shatto, Jr. | 299/37 |
| 3,570,609 | 3/1971 | Wise | 173/131 |
| 3,645,021 | 2/1972 | Sonerud | 37/141 |
| 3,662,843 | 5/1972 | Wise | 173/131 |
| 3,770,322 | 11/1973 | Cobb et al. | 299/37 |
| 3,805,897 | 4/1974 | Cobb et al. | 299/37 X |
| 3,857,609 | 12/1974 | Felix | 299/37 |
| 3,868,145 | 2/1975 | Cobb et al. | 299/37 |
| 3,910,357 | 10/1975 | Nancarrow | 173/131 |
| 3,922,017 | 11/1975 | Cobb | 299/37 X |
| 4,003,603 | 1/1977 | Stemler et al. | 299/37 |
| 4,229,045 | 10/1980 | Gurries | 299/37 |
| 4,229,046 | 10/1980 | Gurries | 299/37 |
| 4,251,111 | 2/1981 | Gurries | 299/37 |
| 4,252,376 | 2/1981 | Gurries | 299/37 |

FOREIGN PATENT DOCUMENTS

| | | | |
|---|---|---|---|
| 293100 | 4/1971 | U.S.S.R. | 173/131 |

*Primary Examiner*—Ernest R. Purser

*Attorney, Agent, or Firm*—Phillips, Moore, Lempio & Finley

[57] ABSTRACT

Previously known ripper apparatus comprise an impacting mechanism for applying impact forces to a ripper tip in an in-line relationship. The high spring rate exhibited by the shank induces high peak internal impact forces, dissipates useful energy, and provides relatively shallow cutting depths. In one aspect, the ripper apparatus (11,11*a*) of this invention overcomes the above problems by providing an offset relationship between a first line ($L_1$) of impacting movement of a ripper tip (13) and a second line ($L_2$) whereat impacting forces are applied to a shank (14,14*a*) carrying the ripper tip (13) and by further providing a spring mechanism (25,25*a*) for ensuring that the impacting forces are transmitted from the second line ($L_2$) to the first line ($L_1$) directly. In another aspect, the spring mechanism (25,25*b*) induces an efficient transfer of impact energy from an impacting mechanism (17) to the material being worked by the ripper tip (13), whether the first ($L_1$) and second ($L_2$) lines are offset or coincident.

17 Claims, 4 Drawing Figures

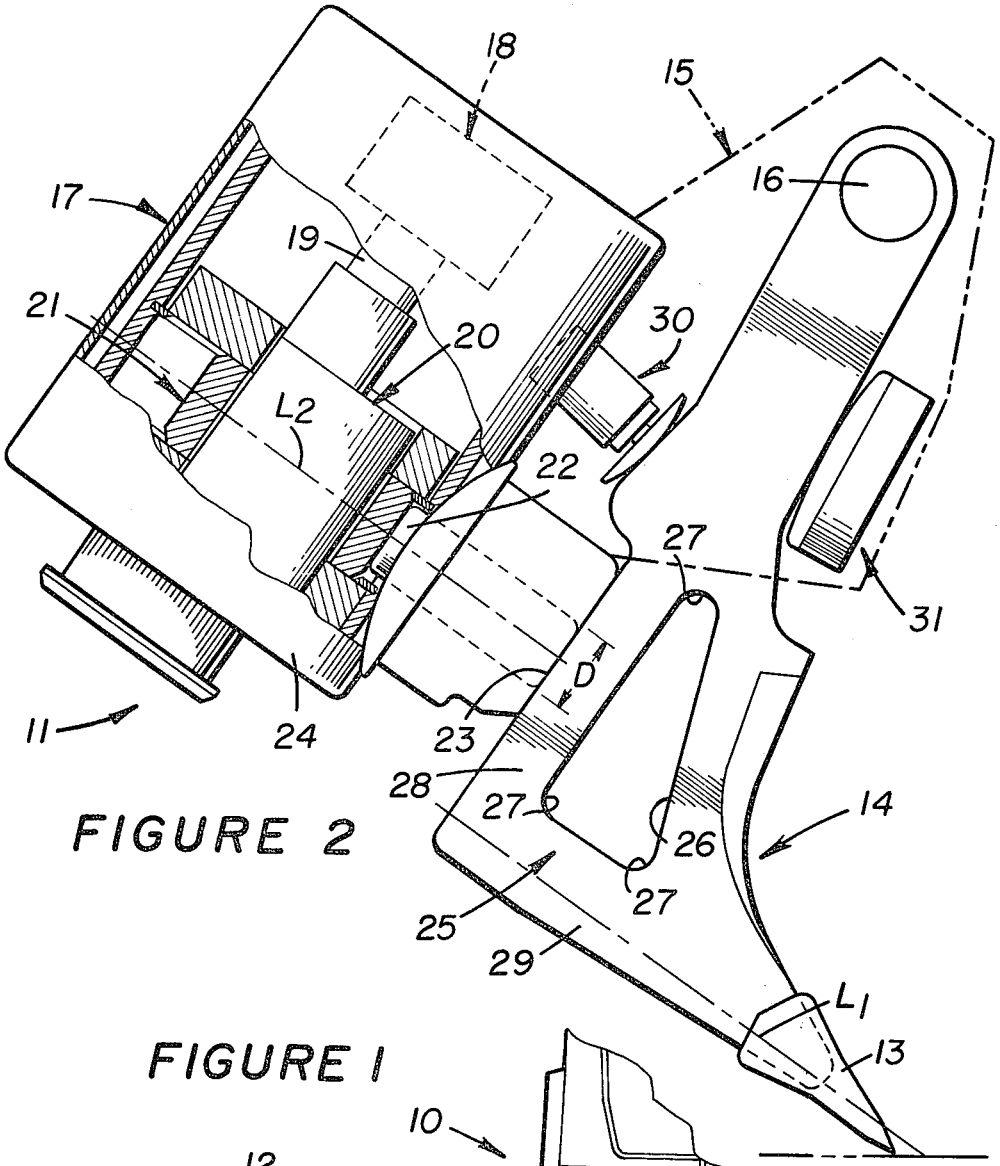
FIGURE 2
FIGURE 1
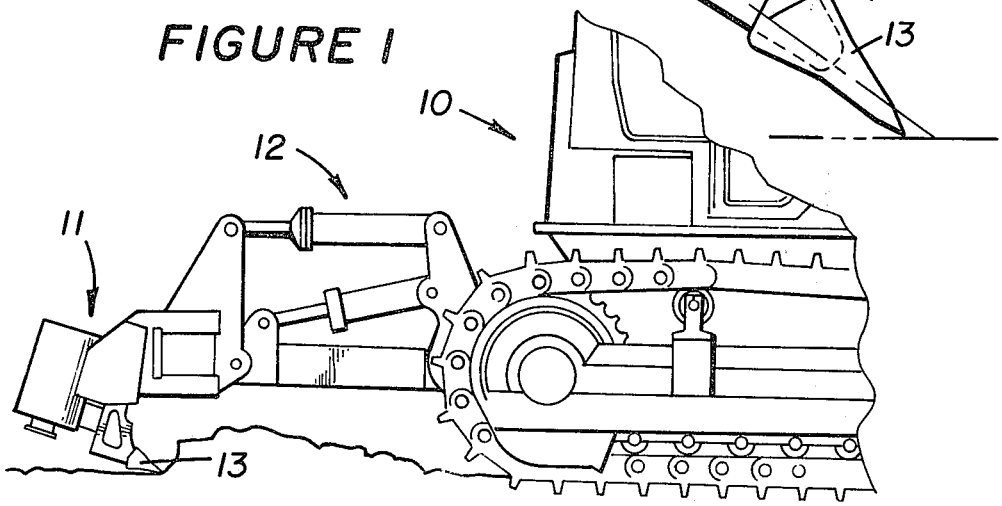

RIPPER WITH OFFSET IMPACTING MEANS AND SLOTTED SHANK

DESCRIPTION

Technical Field

This invention relates generally to a ripper and more particularly to a ripper having an impacting mechanism and means for efficiently transmitting impacting forces from the impacting mechanism to the ripper tip.

BACKGROUND ART

Impact-type rippers include an eccentric cam which functions to intermittently apply an impacting force to a ripper tip for rock ripping purposes. The eccentric cam is aligned with the ripper tip to provide an in-line application of impacting forces thereto, via an intermediate ring-like impact member and impact receiving member. This type of impact ripper is fully disclosed in U.S. Pat. No. 3,868,145, issued on Feb. 25, 1975 to Delwin E. Cobb, Et Al., and assigned to the assignee of this application.

Although impact rippers of this type function quite well, the solid supporting shank for the ripper tip exhibits an impact spring rate that is approximately eight times stiffer than the hardest rock that can be ripped. This relatively high spring rate induces high peak impact forces in the ripper mechanism which could affect the desired service life thereof. In addition, impact energy is dissipated due to the mismatch of the mechanical impedance between the impact member and the shank and between the ripper tip and rock being worked.

Furthermore, conventional impact rippers are designed for relatively shallow cutting depths, e.g., 23 cm. Any attempt to offset the ripper tip from the eccentric cam and attendant impacting mechanisms requires a substantial lengthening of the shank, having the ripper tip secured thereon. The mass of the shank is increased to thus increase internal impacting forces without any appreciable increase in the ripping forces applied to rocks by the ripper tip. Such internal impacting forces tend to produce high moments which cause increased pivot pin loads and also induce ripper tip deflections, resulting in lower cutting efficiency.

The present invention is directed to overcoming one or more of the problems as set forth above.

DISCLOSURE OF INVENTION

In one aspect of this invention, a ripper apparatus has a movable support member, a ripper tip mounted on the support member for movement along a first line, and impacting means for applying an impacting force to the support member in the direction of a second line. The improvement in the above apparatus comprises the disposition of the first and second lines in offset relationship relative to each other and spring means, between the impacting means and the ripper tip, for inducing transmission of the above impacting force from the second line to the first line directly.

In another aspect of this invention, the improvement comprises the spring means including a slot disposed transversely relative to each of the first and second lines.

In still another aspect of this invention, means are provided for inducing a matching of the mechanical impedance between the impacting means and the support member and between the ripper tip and material being worked. Such means is adapted for use with ripper apparatus wherein the above first and second lines are offset or co-incident.

The impact apparatus of this invention is highly efficient in operation and is capable of making deep cuts, e.g., 51 cm. in depth. The apparatus functions to decrease the impact spring rate which, in turn, promotes efficient energy transmission and lowers internal impacting forces to prolong the service life of the components of the ripper apparatus. The cutting portion of the support member or shank is substantially relieved of any bending moments to provide the leading edge of the shank and ripper tip with a high stiffness for efficiently fracturing rocks and the like. The ripping apparatus of this invention provides the above desiderata without increasing its complexity over conventional ripper apparatus.

BRIEF DESCRIPTION OF THE DRAWINGS

Other objects and advantages of this invention will become apparent from the following description and accompanying drawings wherein:

FIG. 1 is a partial side elevational view of a tractor having a ripper apparatus embodiment of the present invention mounted rearwardly thereon;

FIG. 2 is an enlarged, partially sectioned side elevational view of the ripper apparatus.

BEST MODE OF CARRYING OUT THE INVENTION

Figure 3:
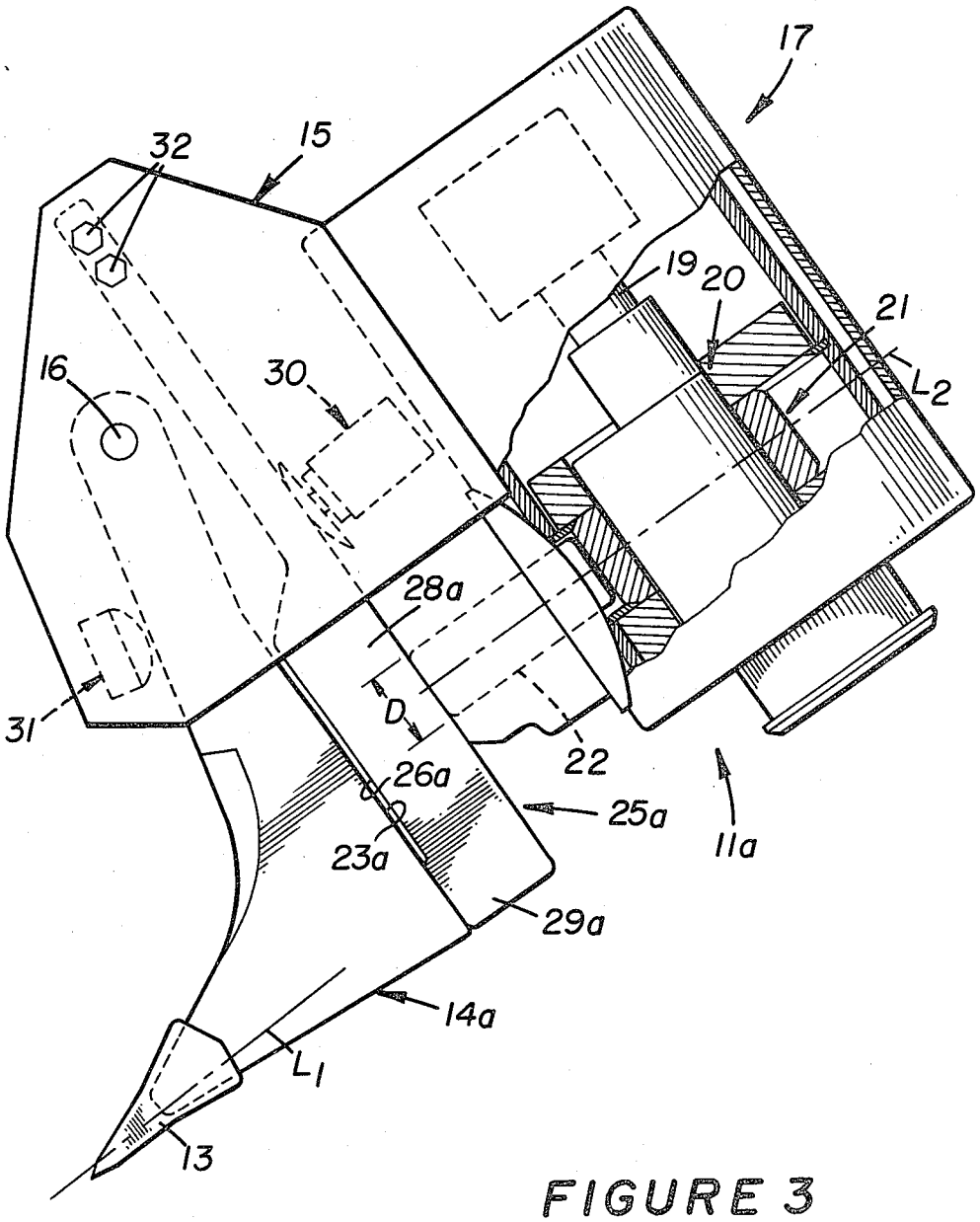
FIGS. 3 and 4 are views similar to FIG. 2, but illustrate modifications of the ripper apparatus.

FIG. 1 partially illustrates a track-type tractor 10 having a ripper apparatus 11 mounted rearwardly thereon by a parallelogram-type linkage 12. Linkage 12 is adapted to raise and lower ripper apparatus 11 to engage a ripper tip 13 thereof with ground level for ground and rock ripping purposes.

Referring to FIG. 2, ripper tip 13 is detachably connected in a conventional manner to a support member or shank 14 for impacting movement, generally along a center line $L_1$ thereof. An upper end of shank 14 is pivotally mounted on a support bracket 15 of ripper apparatus 11 by a pin 16. Impacting forces are intermittently applied to shank 14 by an impacting means 17, such as the type disclosed in above-referenced U.S. Pat. No. 3,868,145.

In general, impacting means 17 may include an hydraulic motor 18 having a rotary output shaft 19 secured to an eccentric cam or crankshaft 20 which is mounted within a ring-like impact member 21. Impact member 21 is adapted to be impacted against an impact receiving member 22, disposed between impact member 21 and a rearward surface 23 of shank 14. Although impact member 21 could engage shank 14 directly, intermediate impact receiving member 22 is preferred to enable the use of sealing means (not shown) between a housing 24 of impacting means 17 and member 22 to prevent the escape of lubricating oil from the housing.

It should be noted in FIG. 2 that center line $L_1$ of ripper tip 13 and center line $L_2$ of eccentric 20 and impacting member 21 are substantially offset relative to each other, and are at least approximately disposed in parallel relationship. Since shank 14 will pivot about pin 16 when impacting forces are applied thereto by impacting means 17, line $L_1$ will vary slightly from a true parallel relationship relative to line $L_2$ during operation. One aspect of the present invention resides in the offset relationship of lines $L_1$ and $L_2$ coupled with the provision of a spring means 25 for inducing transmission of impacting forces from impacting means 17 and line $L_2$ to line $L_1$ of ripper tip 13 directly.

In the FIG. 2 embodiment of this invention, spring means 25 includes an elongated and triangular slot 26 formed completely through shank 14 and preferably disposed to straddle a distance D defining surface portions on rearward surface 23 of shank 14 which are engaged by member 22 for applying impacting forces to the shank. Opposite ends 27 of slot 26 are preferably relieved by circular cutouts to eliminate the potential for any stress risers thereat. Slot 26 thus defines a spring portion 28 on shank 14, disposed between member 22 and slot 26, which will deflect when impacting forces are applied to the shank by impacting means 17.

Assuming the absence of slot 26 in shank 14, i.e., the shank being solid, certain functional disadvantages would result. For example, larger internal impacting forces would result from the increased stiffness and mass of the shank. As described more fully hereinafter, useful energy would also be dissipated due to the mismatch of the mechanical impedences in the system. The service life and overall efficiency of ripper apparatus 11 would thus be disadvantageously affected.

However, the utilization of spring means 25 in the form of through-triangular slot 26 will ensure that impacting forces applied to shank 14 by impacting means 17 will be transmitted substantially directly to center line $L_1$ of ripper tip 13. The offset relationship of lines $L_1$ and $L_2$ thus facilitates the design of a ripping apparatus which can produce substantially deep cuts, e.g., 51 cm., with the addition of spring means 25 ensuring that internal impacting forces are substantially reduced. Also, the mass of the lower section 29 of shank 14 ensures nonbending of ripper tip 13.

FIG. 2 further illustrates a pair of standard dampers or damping means 30 and 31, mounted on bracket 15 and disposed on either side of shank 14, for damping oscillation of the shank. The dampers may be spring-loaded or may include a dash-pot of standard design.

FIG. 3 illustrates a modified ripper apparatus **11*a* wherein identical numerals depict corresponding constructions, but with numerals depicting modified constructions in FIG. 3** being accompanied by an "a".

Ripper apparatus **11*a* differs from ripper apparatus 11 in that a corresponding spring means 25*a* for inducing transmission of impacting forces from line $L_2$ to line $L_1$ directly comprises a cantilevered member 28*a* having its upper end secured to bracket 15 by a pair of bolts 32. Member 28*a* has an impact portion 29*a* defined on a lower end thereof for transmitting impacting forces along an aligned center line $L_1$ of ripper tip 13. Impact portion 29*a* is defined by an elongated slot or recess 26*a* formed on a foward side of member 28*a* to maintain the other portions of member 25*a* in out-of-contact relationship with respect to a rearward surface 23*a* of a slightly modified shank 14*a***.

Upon application of impacting forces to the rearward side of member **28*a* by member 22, member 28*a* will flex like a spring fork and transmit such forces directly to ripper tip 13 via portion 29*a* of member 28*a*. Slot 26*a* is preferably disposed on member 28*a* to straddle member 22, as depicted by distance D. It should be further noted in FIG. 3 that dampers 31 and 30 are arranged to dampen oscillation of shank 14*a* and member 25*a***, respectively.

This arrangement allows the use of a smaller impactor shank which, because of its weight, can be replaced more readily than a heavier shank. It should be noted in FIGS. 2 and 3 that each spring means 25 and **25*a*** is located between the respective impacting means and ripper tips.

Figure 4:
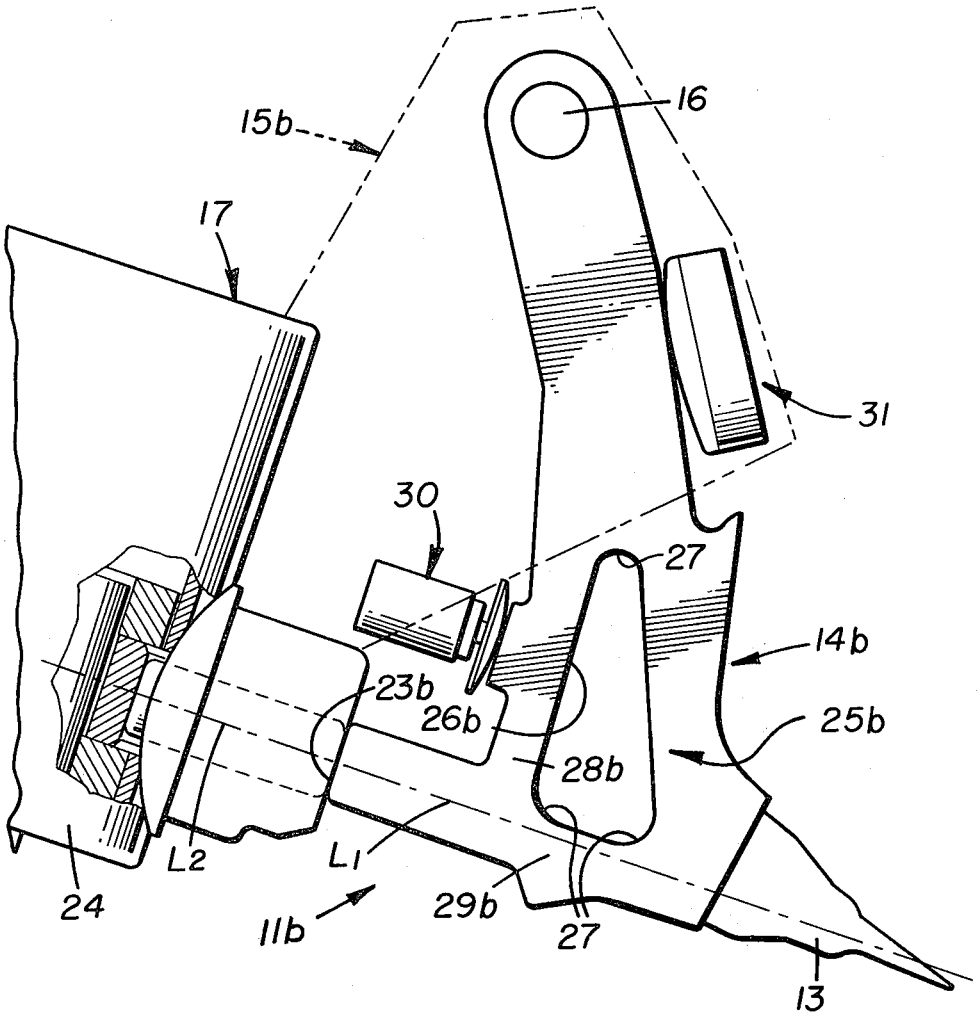

FIG. 4 illustrates a modified ripper apparatus **11*b* wherein identical numerals depict corresponding constructions, but with numerals depicting modified constructions in FIG. 4** being accompanied by a "b".

Ripper apparatus **11*b* differs from ripper apparatus 11 (FIG. 2) in that lines $L_1$ and $L_2$ are coincident, rather than offset. In this aspect of the invention, spring means 25 functions to improve impact energy transfer by inducing a matching of the mechanical impedance between impacting means 17 and the respective support members 14 and 14*b* and between ripper tip 13 and the material or rock being worked. The dissipation of useful energy is thereby greatly reduced and the working efficiency (energy output divided by energy input) of the ripper apparatus is significantly increased in comparison to conventional ripper apparatus having solid support members or shanks. Otherwise stated, the addition of spring means 25 to shanks 14 and 14*b* in the form of through slots 26 changes the spring rates and fundamental frequency responses thereof to maximize the amount of energy delivered by ripper tip 13** to the rock being worked.

In addition to providing a "softer" shank spring, slot 26 substantially decreases the shank mass, e.g., by approximately 15%. Although the coincident alignment of lines $L_1$ and $L_2$ in FIG. 4 does not provide as low an impact force, as felt by the mechanism, as the offset relationship of the lines in FIG. 2, ripper apparatus **11*b* is substantially more efficient than a conventional ripper apparatus having a solid shank. Ripper apparatus 11*b* illustrates that the inventive concept of spring means 25** can be added to a conventional shank to increase the performance efficiency thereof, with only minor modification.

Industrial Applicability

Ripper apparatus 11, **11*a*, and 11*b* find particular application to track-type tractors and the like for breaking rock. As shown in FIG. 1, ripper apparatus 11 is mounted on the tractor by a standard parallelogram-type linkage 12** whereby the ripper apparatus can be raised, lowered, and inclined relative to ground level for maximum cutting efficiency.

As shown in FIG. 2, rotation of output shaft 19 of motor 18 will, in turn, rotate eccentric cam 20 to reciprocate impact member 21 against member 22. The intermittent application of impacting forces to rearward surface 23 of shank 14 by member 22 will oscillate ripper tip 13 for rock breaking purposes. The interposition of spring means 25 between center line $L_2$ of eccentric 20 and center line $L_1$ of ripper tip 13 will ensure that substantially all of the impacting forces applied to shank 14 will be transmitted to ripper tip 13 directly with a substantially low internal impact force and that energy transmission to the ripper tip will be maximized.

Ripper apparatus **11*a* and 11*b* of FIGS. 3 and 4, respectively, function in a similar manner, as described above. The offset relationship of center lines $L_1$ and $L_2$ of ripper apparatus 11 and 11*a*** will facilitate the making of substantially deeper cuts than have been heretofore accomplished with impacting ripper apparatus wherein such center lines are at least substantially coincident.

Other aspects, objects, and advantages of this invention can be obtained from a study of the drawings, the disclosure, and the appended claims.

We claim:

1. In a ripper apparatus (11,11*a*), having a movable support member (14,14*a*), a ripper tip (13) mounted on said support member and disposed for impacting movement along a first line ($L_1$), and an impacting means (17) for intermittently applying an impacting force to said support member (14,14*a*) in the direction of a second line ($L_2$), the improvement comprising said first ($L_1$) and second ($L_2$) lines being substantially offset relative to each other and spring means (25,25*a*) between said impacting means (17) and said ripper tip (13) for inducing transmission of said impacting force from said second line ($L_2$) to said first line ($L_1$) directly.

2. The ripper apparatus of claim 1 wherein said first ($L_1$) and second ($L_2$) lines are at least approximately parallel.

3. The ripper apparatus of claim 1 wherein said spring means (25,25*a*) includes a slot (26,26*a*) disposed transversely relative to each of said first ($L_1$) and second ($L_2$) lines.

4. The ripper apparatus of claim 3 wherein said impacting means (17) includes a reciprocal impact member (22) and wherein said slot (26,26*a*) is disposed in straddling relationship relative to said impact member (22).

5. The ripper apparatus of claim 4 wherein said slot (26) is formed through and within said support member (14) to define a spring portion (28) thereon disposed between said impact member (22) and said slot (26).

6. The ripper apparatus of claim 5 further including damping means (30,31) for damping oscillation of said support member (14), said damping means (30,31) being disposed on either side of said support member (14).

7. The ripper apparatus of claim 4 wherein said spring means (25*a*) includes a cantilevered member (28*a*) disposed between said impact member (22) and said support member (14*a*), and said slot (26*a*) is formed on said cantilevered member (28*a*) to define an impact portion (29*a*) of said cantilevered member (25*a*) aligned with said first line ($L_1$).

8. The ripper apparatus of claim 7 further including damping means (30,31) for damping oscillation of said support member (14*a*) and said cantilevered member (28*a*).

9. In a ripper apparatus (11,11*b*) having a movable support member (14,14*b*), a ripper tip (13) mounted on said support member and disposed for impacting movement along a first line ($L_1$), and an impacting means (17) for intermittently applying an impacting force to said support member (14,14*b*) in the direction of a second line ($L_2$), the improvement comprising means (25,25*b*) for inducing a matching of the mechanical impedance between said impacting means (17) and said support member (14,14*b*) and between said ripper tip (13) and material being worked thereby.

10. The ripper apparatus of claim 9 wherein said first ($L_1$) and second ($L_2$) lines are substantially offset relative to each other.

11. The ripper apparatus of claim 9 wherein said first ($L_1$) and second ($L_2$) lines are at least substantially coincident relative to each other.

12. The ripper apparatus of claim 9 wherein said last-mentioned means (25,25*b*) includes a slot (26,26*b*) disposed transversely relative to each of said first ($L_1$) and second ($L_2$) lines and formed through said support member (14,14*b*).

13. The ripper apparatus of claim 12 wherein said impacting means (17) includes a reciprocal impact member (22) and wherein said slot (26) is disposed in straddling relationship relative to said impact member (22).

14. The ripper apparatus of claim 12 wherein said impacting means (17) includes a reciprocal impact member (22) and wherein said impact member (22) is positioned adjacent to a lower end of said slot (26*b*) in general alignment with said ripper tip (13).

15. The ripper apparatus of claim 12 wherein said slot (26,26*b*) is formed through said support member (14) to define a spring portion (28,28*b*) on a rearward side of said support member (14,14*b*).

16. The ripper apparatus of claim 9 further including damping means (30,31) for damping oscillation of said support member (14), said damping means (30,31) being disposed on either side of said support member (14).

17. A ripper apparatus (11,11*a*) comprising a movable support member (14,14*a*), a ripper tip (13) mounted on said support member and disposed for impacting movement along a first line ($L_1$), impacting means (17) for intermittently applying an impacting force to said support member (14,14*a*) in the direction of a second line ($L_2$), said first ($L_1$) and second ($L_2$) lines being substantially offset relative to each other, and spring means (25,25*a*) for inducing transmission of said impacting force from said second line ($L_2$) to said first line ($L_1$) directly, said spring means (25,25*a*) including a slot (26,26*a*) disposed transversely relative to each of said first ($L_1$) and second ($L_2$) lines.

* * * * *